US008167736B2

(12) United States Patent
Vald'Via et al.

(10) Patent No.: US 8,167,736 B2
(45) **Date of Patent: *May 1, 2012**

(54) SHAFT CAP ASSOCIATED WITH GOLF CLUBS AND METHODS TO MANUFACTURE GOLF CLUBS

(75) Inventors: Gil G. Vald'Via, Phoenix, AZ (US); Marty R. Jertson, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/006,214

(22) Filed: Jan. 13, 2011

(65) Prior Publication Data

US 2011/0111878 A1 May 12, 2011

Related U.S. Application Data

(62) Division of application No. 11/962,573, filed on Dec. 21, 2007, now Pat. No. 7,892,107.

(51) Int. Cl.
*A63B 53/02* (2006.01)

(52) U.S. Cl. ..... 473/309

(58) Field of Classification Search ..... 473/305, 473/308–310, 312, 316–323
See application file for complete search history.

(56) References Cited

U.S. PATENT DOCUMENTS 5,902,656 A * 5/1999 Hwang ..... 428/36.91
2003/0207720 A1* 11/2003 Sery ..... 473/256

* cited by examiner

*Primary Examiner* — Stepheh L. Blau

(57) ABSTRACT

A golf club comprising a grip, a shaft having a first end and a second end, with the first end of the shaft having the grip disposed upon it, a shaft cap disposed at the second end of the shaft, and a head having a face portion and a hosel portion with the second end of the shaft having the shaft cap disposed on the shaft coupled to the head.

12 Claims, 15 Drawing Sheets

800

500

800

1200

1500

SHAFT CAP ASSOCIATED WITH GOLF CLUBS AND METHODS TO MANUFACTURE GOLF CLUBS

CROSS-REFERENCE TO RELATED APPLICATIONS

This is a divisional application of U.S. Ser. No. 11/962,573, filed on Dec. 21, 2007, which is incorporated herein by reference in its entirety.

TECHNICAL FIELD

This description relates generally to production parts and their manufacturing processes and more specifically to golf clubs and the manufacturing process of producing golf clubs.

BACKGROUND

Industrial automation can provide many challenges in producing a product. Often, a particular industrial process may be applied to the production of many different products, often by simply retooling, or providing different parts for application of the similar process. Likewise, certain operations used in the production of golf clubs may also be utilized in other industrial operations as well.

The production of golf clubs is increasingly automated to keep up with the demand for quality clubs generated by the popularity of the sport. High quality clubs can be a challenge to produce efficiently, due to the challenges in producing a product that typically has parts that may be accurately aligned, and may incorporate the fitting of custom components into an aligned assembly.

The durability of a golf club may also be of concern. However, golf clubs are typically subjected to a number of forces while being used and as such, there can be a number of challenges assembling them so that they may perform satisfactorily and are durable. Golf clubs can include a variety of materials. Thus, in manufacturing quality clubs, the process of producing the clubs and the choice and configuration of components used in a golf club can affect the performance and manufacturability of golf clubs. Typically, finding the proper combination of components to construct a club that performs well can be a challenge. Thus, there can be a number of issues in manufacturing such clubs, so that a quality golf club may be produced.

DESCRIPTION OF THE DRAWINGS

The present description will be better understood from the following detailed description read in light of the accompanying drawings, wherein.

Like reference numerals are used to designate like parts in the accompanying drawings.

DESCRIPTION

The description provided below, in connection with the appended drawings, is intended as a description of the present examples and is not intended to represent the only forms in which the present examples may be constructed or utilized. The description sets forth the functions of the example and the sequence of steps for constructing and operating the example. However, the same or equivalent functions and sequences may be accomplished by different examples.

The examples below describe a golf club with a shaft cap, including methods to construct one. Although the present examples are described and illustrated herein as being implemented in a golf club assembly, the assembly described is provided as an example and not a limitation. As those skilled in the art will appreciate, the present examples are suitable for application in a variety of different types of golf clubs, such as, woods, irons, putters and the like. The assembly technique described may also be employed in any manufacturing setting in which a shaft is aligned in a bore or hole.

A golf club may be constructed with a shaft cap that may increase the quality of the club and also may increase the manufacturing efficiency in producing the club. Such a club with a shaft cap may reduce "spinners", "squeakers", the use of pneumatic hammers, misaligned shaft graphics, misaligned shafts, and the like. These concepts will be further explained below. By placing a shaft cap at the end of a shaft when the shaft is inserted into a hole or a bore of a golf club head, attachment of the shaft to the head may be improved. The shaft cap may act as a spacer and/or a plunger to center the shaft in the bore and to force an adhesive such as, epoxy up between the shaft and the wall of the hole bored in the head and to prevent unwanted flow of adhesive into the interior of the shaft.

Figure 1:
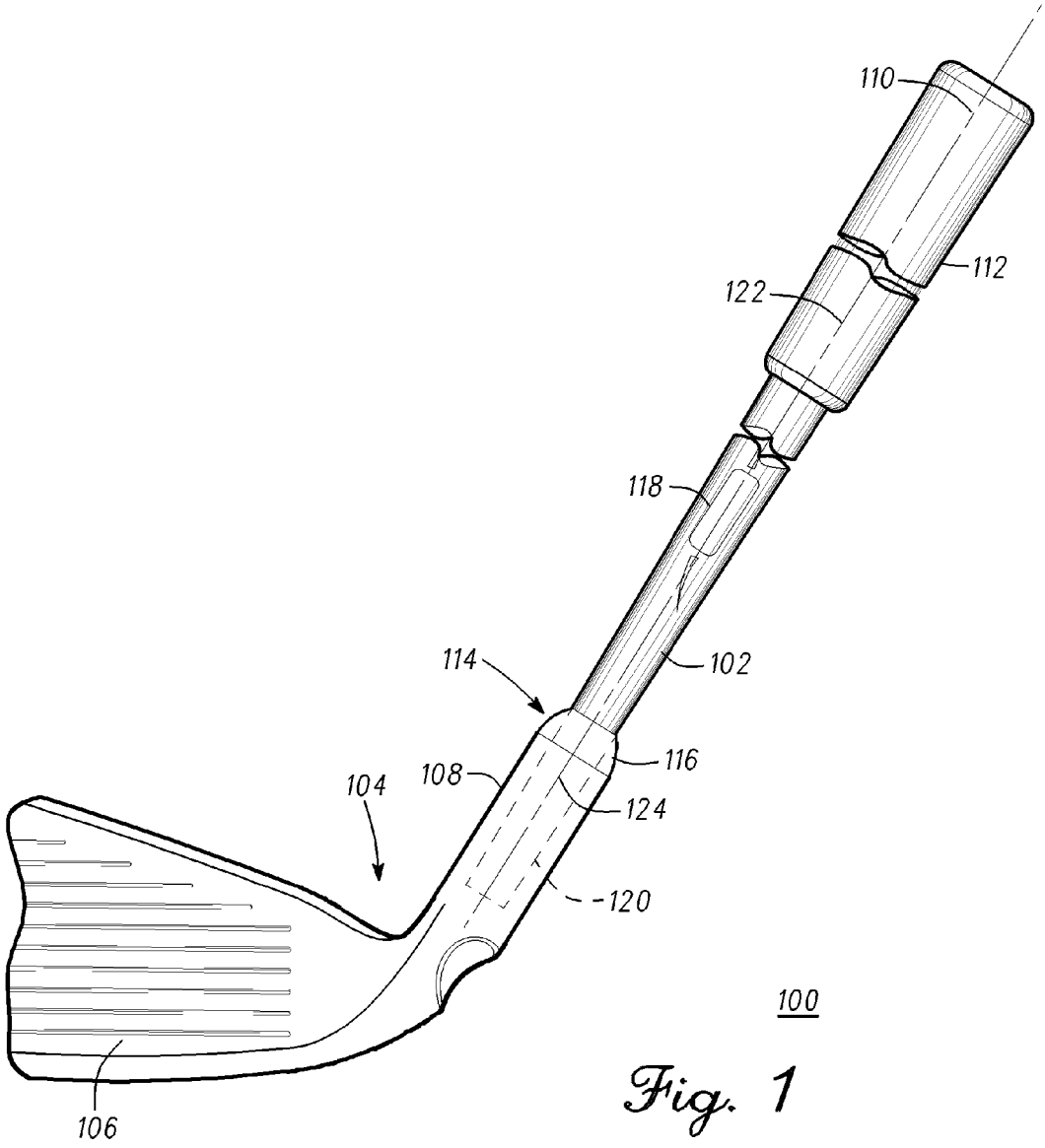
FIG. 1 shows an example golf club.

FIG. 1 shows an example of a golf club 100. Although FIG. 1 may depict an iron-type golf club, the methods, apparatus, and articles of manufacture described herein may be applicable to other types of golf clubs such as a wood-type golf club, a hybrid-type golf club, a putter-type golf club or the like. The golf club 100 may include a grip 112, a shaft 102 and a head 104. The head 104 includes a face 106 and a hosel 108 (e.g., an integral or separate portion of the head 104 to receive the shaft 102). Alternatively, the head 104 may include a bore (not shown) instead of the hosel 108. The grip 112 allows an individual to maintain a firm grasp of the golf club 100, and may provide a cushion as force from striking a ball (not shown).

The head 104 may be made from any suitable material or combination of materials such as composites, wood, metal (pure or alloy) or the like. The face 106 of the club 100 may contact a golf ball. The hosel 108 may provide an area where attachment to a shaft 102 may be provided, for example, by securing the shaft 102 to a cast bore. In one example, hosel bores may be tapered. The head 104 may also incorporate various devices, such as inserts or faces (often made having various patterns), weights and the like (not shown) to improve an individual's swing.

The shaft 102 may be wood, metal, graphite, fiberglass, or any other suitable material. The shaft 102 may include two ends: a first end (e.g., a grip end 110) and a second end (e.g., or hosel end 114). The grip 112 may be disposed at the grip end 110 so that an individual can firmly grasp the club 100. At the opposite end 114, the shaft 102 may be coupled to the head 104 through the hosel 108. The shaft 102 may allow an individual to transfer the force of his or her swing to the head 104 and subsequently to the ball. The shaft 102 may be subjected to forces and bends or flexes accordingly. Accordingly, a number of shaft geometries may be designed or formed to accommodate the dynamic forces of a swing, and various shaft designs or their equivalents may be utilized.

A ferrule 116 may be provided to cover or mask attachment of the head 104 to the shaft 102 or to generally improve club appearance. The ferrule 116 covers up the joint formed by the attachment of the shaft 102 to the head 104 and to mask misalignment. However, the ferrule 116 may be omitted if the golf club 100 is designed to have a good fit between the shaft 102 and the hosel 108 so that the joint does not need masking.

The shaft 102 may also include a shaft graphic, or label, 118 disposed on it. The graphic 118 may be lined up with the head 104 so that an individual, when holding the club, looks down and sees the graphic 118 as he or she is looking at the ball and the head 104. The graphic 118 may be a decal, applied tag, emblem or any suitable graphic device.

When attaching the shaft 102 to the head 104, the long axis of shaft 122 may be aligned with the long axis 124 of a bore 120 disposed in the hosel 108. If alignment is not sufficiently maintained, the effect may be detrimental to an individual's ability to hit the ball accurately. For example, a one degree variation in alignment of the shaft center line 122 to the center line of the bore 124 may be detrimental to the designed loft of the golf club 100. Other variations in alignment and centering are also possible.

Figure 2:
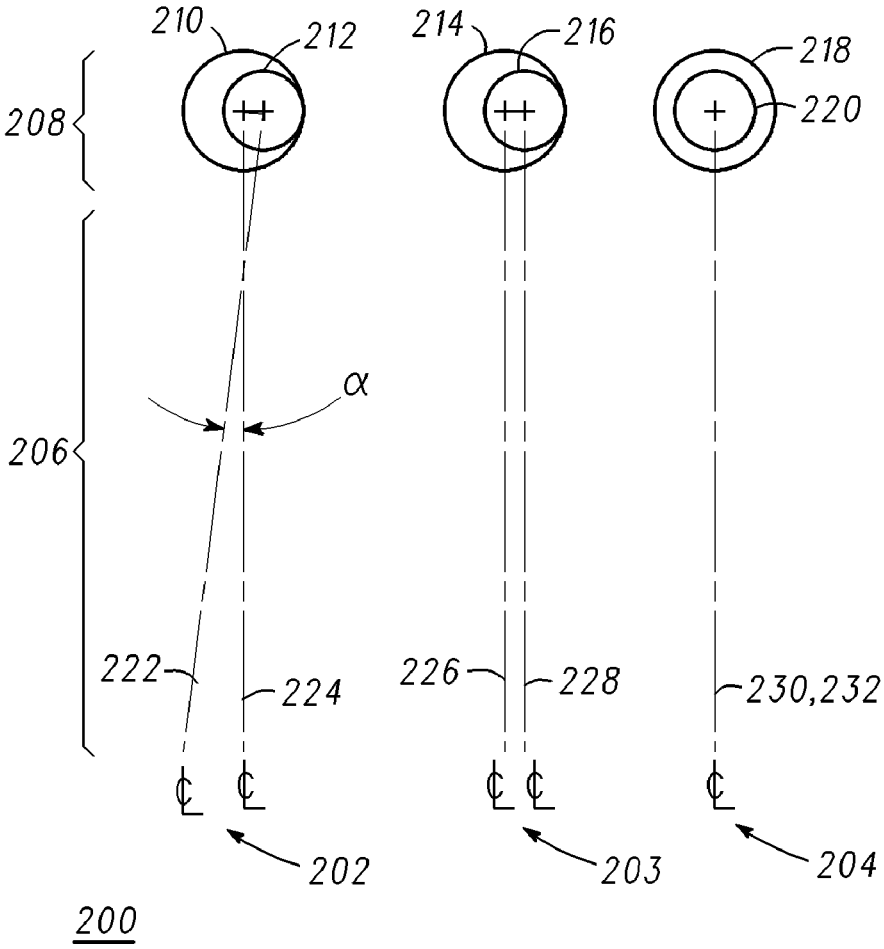
FIG. 2 shows variations in alignment between a golf club shaft and a hosel bore that may occur during assembly.

FIG. 2 shows variations in alignment between a golf club shaft and a hosel bore that may occur during assembly 200. For example, alignments 202, 203, 204 between the shaft and the hosel bore are shown in this diagram. The alignments 202, 203, and 204 are shown as viewed from the top, or looking into the end of the shaft 208, and also as they would look when viewed from the side 206. In particular, misalignment 202, parallel alignment 203, and coincident alignment 204 are shown.

Misalignment, or crossed alignment 202 may occur when center line of the shaft 222 and the center line of the bore 224 are crossed as shown from the side 206. Viewed from the top 208, the center of the bore hole 210 and the center of the circle representing the shaft 212 are not concentric. In the plane shown 208, one of either the shaft, or the bore outlines would actually appear somewhat elliptical in this plane due to the crossed alignment. Misalignment 202 may affect the designed loft of the club as the angle ("$\alpha$") between the shaft and bore may add or subtract from any tilt or angle designed into the club.

The parallel alignment 203 of the shaft and the bore can provide sufficient alignment depending upon the distance between the center lines 226, 228. As shown, the center line of the shaft 226 and the center line of the bore 228 are substantially parallel when viewed from the side 206 but they are not coincident with each other. This may be seen from the end view 208 where the center of the bore 214 and the center of the shaft 216 do not overlap to form concentric circles. However, in this plane or end view, the hosel bore and circular shaft would both appear circular. The parallel alignment 203 may not affect a club's loft.

An example of an unacceptable parallel alignment would be when the shaft is an unacceptable distance from the wall of the bore. Such an unacceptable alignment may cause uneven distribution of epoxy between the shaft and bore. Uneven distribution may cause a weakened club to shaft bond where the epoxy is thinnest.

An example of acceptable parallel alignment would be a circumference of the shaft in an acceptable distance from the bore wall so that sufficient bonding between the shaft and bore may take place all around the shaft. This spacing, although uneven, may provide sufficient bonding.

Coincident alignment 204 is where the center lines of the shaft 230 and the bore 232 line up when viewed from the side 206 and appear as concentric circles 218, 220, when viewed from the end 208. As viewed from the side, the center lines of the shaft 230 and the bore 232 would appear to lie on top of each other. As viewed from the end, the center of the shaft 220 and the center of the bore 218 appear to have identical centers so that the outline of the bore 218 and the outline of the shaft 220 appear to be concentric circles. This alignment would typically provide an even distribution of epoxy between the shaft and bore, yielding a strong joint.

In each of the three examples described above, manufacturing variances or tolerances may be present. For example, in any given assembly of shaft into a bore, a certain amount of misalignment of the center line 202 may be acceptable depending upon on the tolerances for the given application. Likewise, parallel alignment as shown 203 may be acceptable or not, depending upon the degree of parallel alignment and the distances between the center lines. And finally, for the concentric alignment 204, the overlap may be acceptable within specified tolerances.

Figure 3:
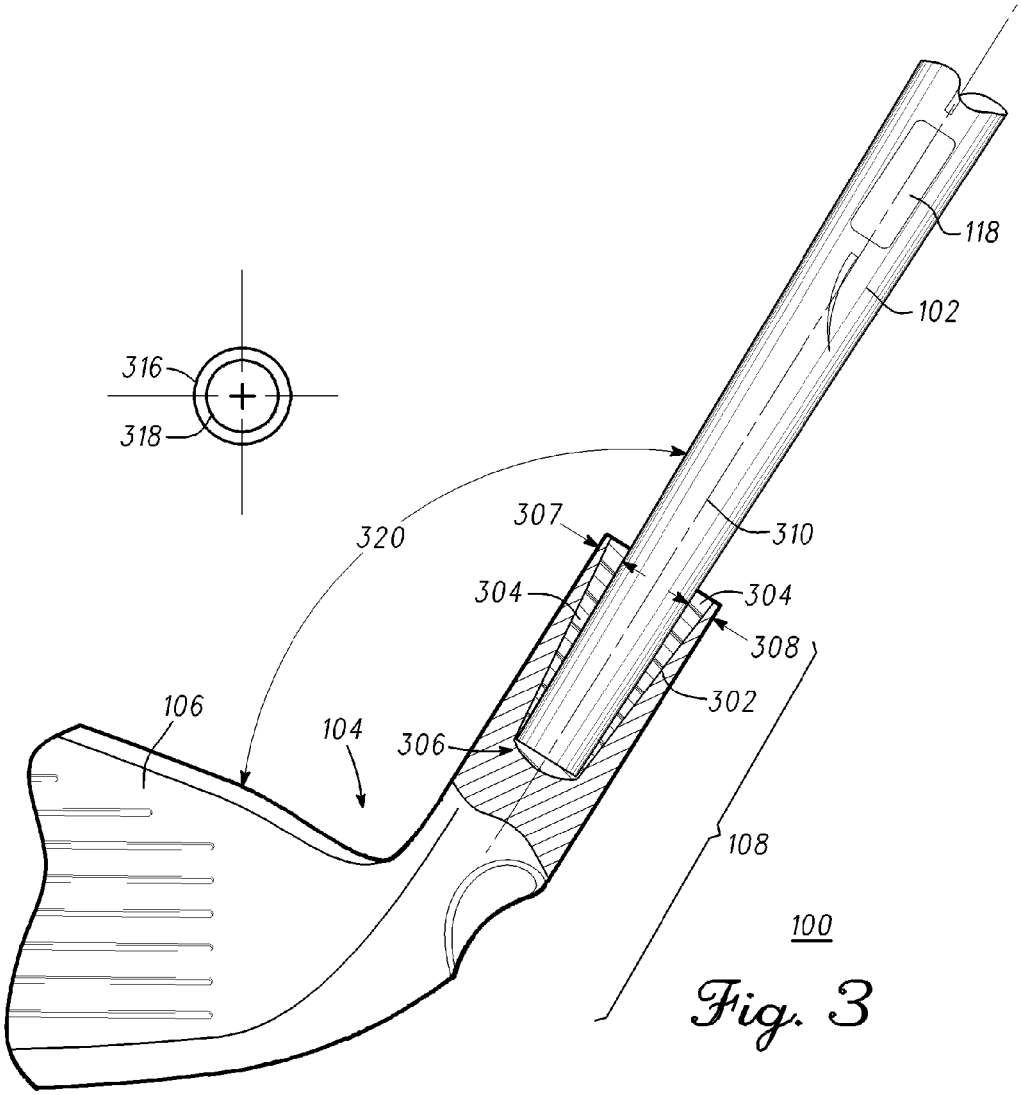
FIG. 3 shows a detailed view of one manner in which a shaft may engage the hosel of the example golf club of FIG. 1.

FIG. 3 shows a detailed view of the hosel 108 of the exemplary golf club 100. The hosel 108 portion of the head 104 is shown in cross section to expose the shaft 102 and illustrate how the shaft 102 may fit into a hosel bore 301, which may be a cast and tapered opening having a bore wall 302. When properly assembled, the shaft 102 and hosel 108 assembly, as viewed from the end, would show the shaft outline 318 centered in the outline of the bore 316 with an even layer of epoxy disposed between the shaft and bore wall. Some assembly processes, such as that shown, may utilize mechanical seating of the shaft 102 to the head 104 and epoxy 304 to fill the void between the shaft 102 and a bore wall 302 of the hosel bore 301.

Manufacturing variations in the shaft 102 diameter and the bore wall 302 in the hosel 108, may be taken into account so most of the pre-manufactured shafts can fit into the hosel bore 301 with sufficient and even gap 307, 308 to allow bonding with the epoxy 304 or other equivalent bonding techniques. Acceptable alignments of the shaft 102 and the hosel bore 301 may be as previously described (FIG. 2, 203 and 204). The bore wall 302 in the hosel 108 may be tapered, and the shaft 102 may be cylindrical but may also be tapered. In addition, the hosel 108 and its bore 301 are often cast, which may result in looser tolerances than a comparable mechanically bored or machined hole.

In assembling the shaft 102 to fit into the hosel bore 301, the epoxy 304 may be disposed about the shaft 102 and on the bore wall 302 of the hosel bore 301. The shaft 102 and the hosel bore 301 may be aligned so that the shaft 102 is centered in the bore 301 with a uniform gap 307, 308 between the shaft 102 and the bore wall 302 of the hosel bore 301. As a result, a uniform bond may be formed about the shaft 102 by the epoxy 304, and concentricity between the shaft 102 and the hosel bore 301 may be maintained (e.g., 204 of FIG. 2). The shaft graphic 118 may be oriented by twisting the shaft 102 until the graphic 118 aligns 320 with the club face 106.

After the epoxy 304 is applied, the shaft 102 may be seated into the hosel bore 301. Seating may be accomplished as the diameter of the bottom of the bore can be less than the diameter of the shaft. As the hosel bore 301 is tapered, the shaft 102 may come to rest on the portion of the bore wall where the bore diameter is close to that of the shaft 306. At this point, the shaft 102 is inserted so that mechanical attachment of the shaft 102 to the hosel bore 301 can be provided in addition to the attachment by gluing or bonding with the epoxy 304. The shaft 102 may be made of a thin-walled metal, which may deform, or crinkle somewhat when it is driven into place, and it may dig into the bore wall 302 of the hosel bore 301 as an interference fit is formed. This type of coupling of a shaft to a golf club head may not be suited to producing uniform or substantially equal gaps 307, 308 between the shaft 102 and the hosel bore wall 302.

Figure 4:
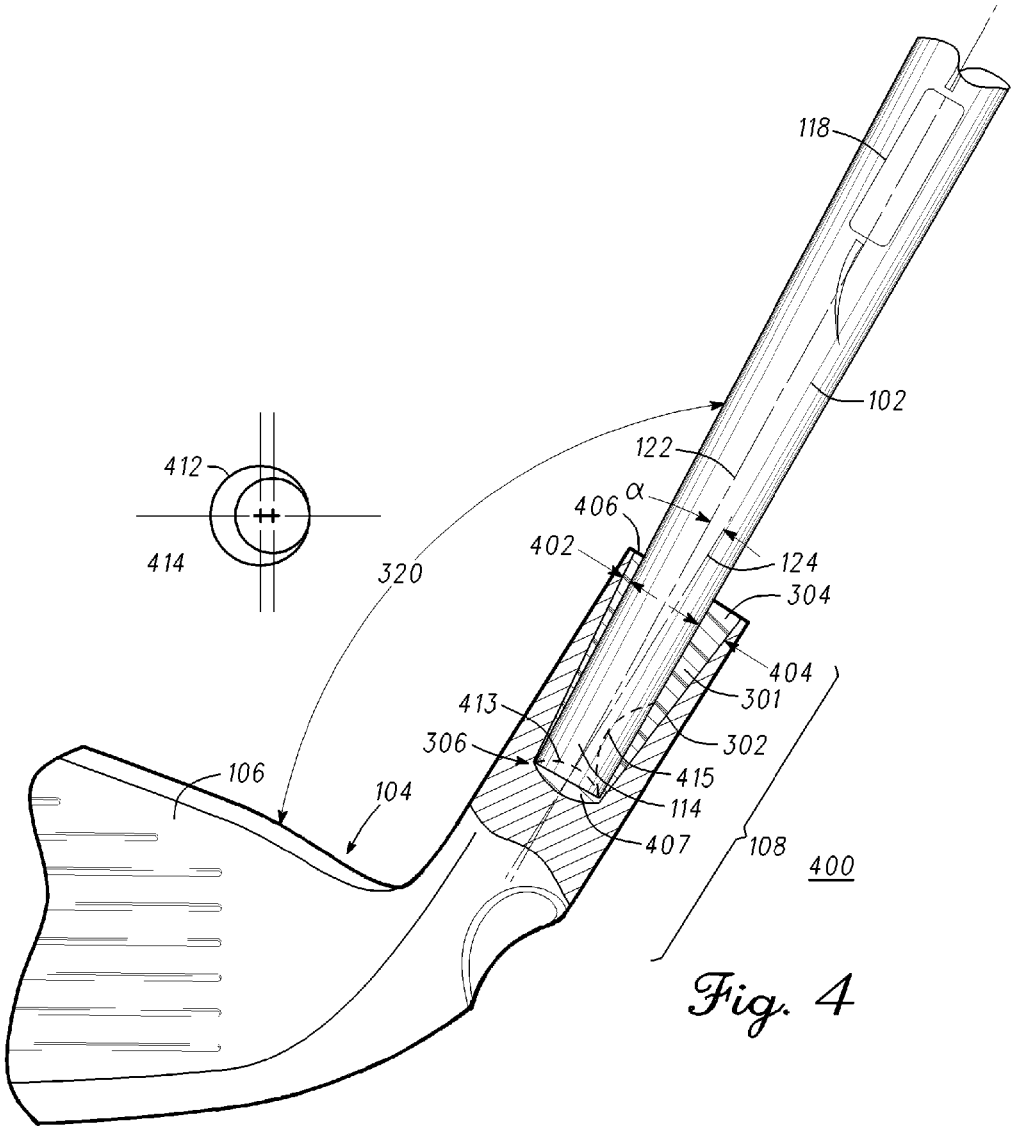
FIG. 4 shows a detailed view of the hosel of the example golf club of FIG. 1.

FIG. 4 shows an example of a golf club 400 where concentricity between the hosel 108, the bore wall 302 and the shaft 102 has not been maintained through mis-insertion and/or as a result of seating the shaft 102 in the hosel bore 301. As shown in this example, a top edge of the hosel bore wall 406 may, contact or come close to the edge of the shaft 102 and the hosel end 114 of the shaft 102 may contact the bottom 407 of the hosel bore 301, which can cause the shaft 102 to set crooked as shown by the angle $\alpha$ and as previously described (202 of FIG. 2). Also, the shaft 102 may not be trimmed squarely on the end 114 inserted into the bore. As a result, the shaft 102 may sit crookedly when inserted in the hose bore 301. Such a misalignment can cause an uneven distribution of the epoxy 304 between the shaft 102 and the hosel bore 301, as shown by unequal distances between the shaft 102 and the bore wall 402, 404.

The previously described misalignment between shaft centerline 122 and bore center line 124 (as previously described in 202 of FIG. 2), or an unacceptable parallel alignment (203 of FIG. 2) may occur in this situation. In assembling the shaft 102 to the hosel 108, the shaft 102 may be driven into the tapered bore 301 by a pneumatic hammer or other equivalent method of seating the shaft 102 in the hosel bore 301. In seating the shaft 102 in the hosel bore 301, the hosel end 114 of the shaft 102 may be forced into the tapered hosel bore 301 until the hosel end 114 seats near the bottom 407 of the hosel bore 301. Inserting the shaft 102 into the hosel bore 301 in this manner, tends to provide for a secure attachment of the shaft 102 to the hosel 108. When seated in this manner, the lip or edge of the shaft 102 may deform at the point of contact (e.g., the bottom 407 of the hosel bore 301). This type of seating may not provide for accurate centering, alignment or a particular degree of repeatability.

When inserting the shaft 102 into the hosel bore 301, it tends to be difficult to maintain alignment shaft 102 with respect to the bore wall 302. Thus, a proper alignment of the shaft 102 in the bore 301 may not be controlled easily, leading to an uneven distribution of the epoxy 304. This can be due to the fact that during the seating process the shaft 102 comes to rest such that it may cause some unevenness in the distance between the shaft 102 and the bore wall 402 and 404. While seating the shaft 102, the previously disposed epoxy 304 may flow into the shaft 102 where it may form a simple bulge 413, or run down the interior wall of the shaft 415. Excess epoxy may flow into the interior of the hollow shaft 102 as it is fluid and its flow is not easily controlled after application. Epoxy running into the inside of the shaft 102 can break off after it cures and the loose pieces may cause a rattling sound to come from the club 100. This uncontrolled flow of epoxy may also lead to other club defects too.

Also, once the shaft 102 has been inserted in this manner, the shaft 102 may not be rotated so that the graphic 118 properly aligns 320 with the club face 106 if shaft 102 has moved during handling or seating. Thus, after initial alignment, or subsequent to the seating or hammering process, if the graphic 118 becomes misaligned, realignment typically is not possible. Once fixed in place by the pneumatic hammer, the shaft 102 may not easily be removed or turned. And, in many manufacturing operations, previously seated shafts are often not reused.

Thus, before seating the shaft into the hosel bore, any graphics 118 disposed on the shaft 102 should be aligned with the club face 106 and alignment should be maintained during seating. After using the pneumatic hammer, rework and realignment of the graphic 118 may not be possible. In one example, metal shaft walls may be 0.14 inch thick and deform at the ends under the force of the pneumatic hammer. Thus, if there is misalignment of the graphic 118 or a non-concentric bonding, the shaft 102 may be pulled out and reseated into place, which can weaken the shaft 102.

Misalignment of the shaft centerline 122 with the bore centerline 124 may also cause a squeaking noise coming from the point of contact or near contact 406 between the bore wall 302 and the shaft 102 or from flexing of the thinned area 402 of epoxy 304. Noise can also be caused by friction of the shaft 102 coming in actual contact against the hosel bore wall 302. Contact can occur when bonding cannot take place, as the epoxy 304 is displaced in this area due to the alignment of the shaft 102 or contact points where it may be seated 402. On the opposite side of the shaft 404, excess epoxy 304 can be present, in fact, more epoxy than is needed to provide a sufficient bond.

Such a misalignment may create an effect known as a "squeaker". In particular, the shaft 102 may rub against the bore wall 302 as the club 400 flexes during a swing causing a squeak or similar noise, which may be an audible distraction.

Other problems can occur if the shaft 102 fails to seat in the hosel bore 301. If the shaft diameter falls on the small end of the tolerance range and/or the diameter of the hosel bore 301 tends to fall on the large side, a "spinner" may occur. A spinner is a club and head assembly that cannot be fixed, or seated, during the manufacturing operation. After application of the pneumatic hammer or similar force, for example, the shaft 102 may not seat properly in the hosel bore 301 and the shaft 102 may spin around in the hosel bore 301. Such a defect may require rework or discarding of one or more pieces of the club 400 and substitution of another shaft that may fit better.

When assembling a shaft to a club head as described above, a technician may dispense epoxy on a towel and spread epoxy on the bore wall 302 (e.g., inside the hosel bore) while another technician may spread epoxy on the outside of the shaft 102 at the hosel end 114. The shaft can then be inserted into the head 104 and the pneumatic hammer can then be applied to firmly seat the shaft 102 into the hosel bore 301. After the shaft 102 is inserted into the hosel 108 and seated, another technician typically wipes excess epoxy that may flow out of the hosel bore 301 leaving a smooth joint without any need for masking by a device such as a ferrule or the like (not shown).

As can be seen above, in manufacturing, it may be desirable to provide a way to couple a shaft 102 to a hosel 108 so that epoxy 304 usage is minimized, bond strength is improved, shaft 102 and head 104 alignment 320 is maintained, spinners may be eliminated and graphics 118 alignment can be easily performed. In use of the club 400, it may be desirable to provide a method of attaching the shaft 102 to the head 104 that may improve concentricity (203, 204 of FIG. 2) to provide a reliable degree of loft, allows improved alignment 320 of the shaft graphics 118 of the head 104, tends to eliminate squeakers, tends to eliminate rattles and in general tends to improve the quality of the club 400.

Figure 5:
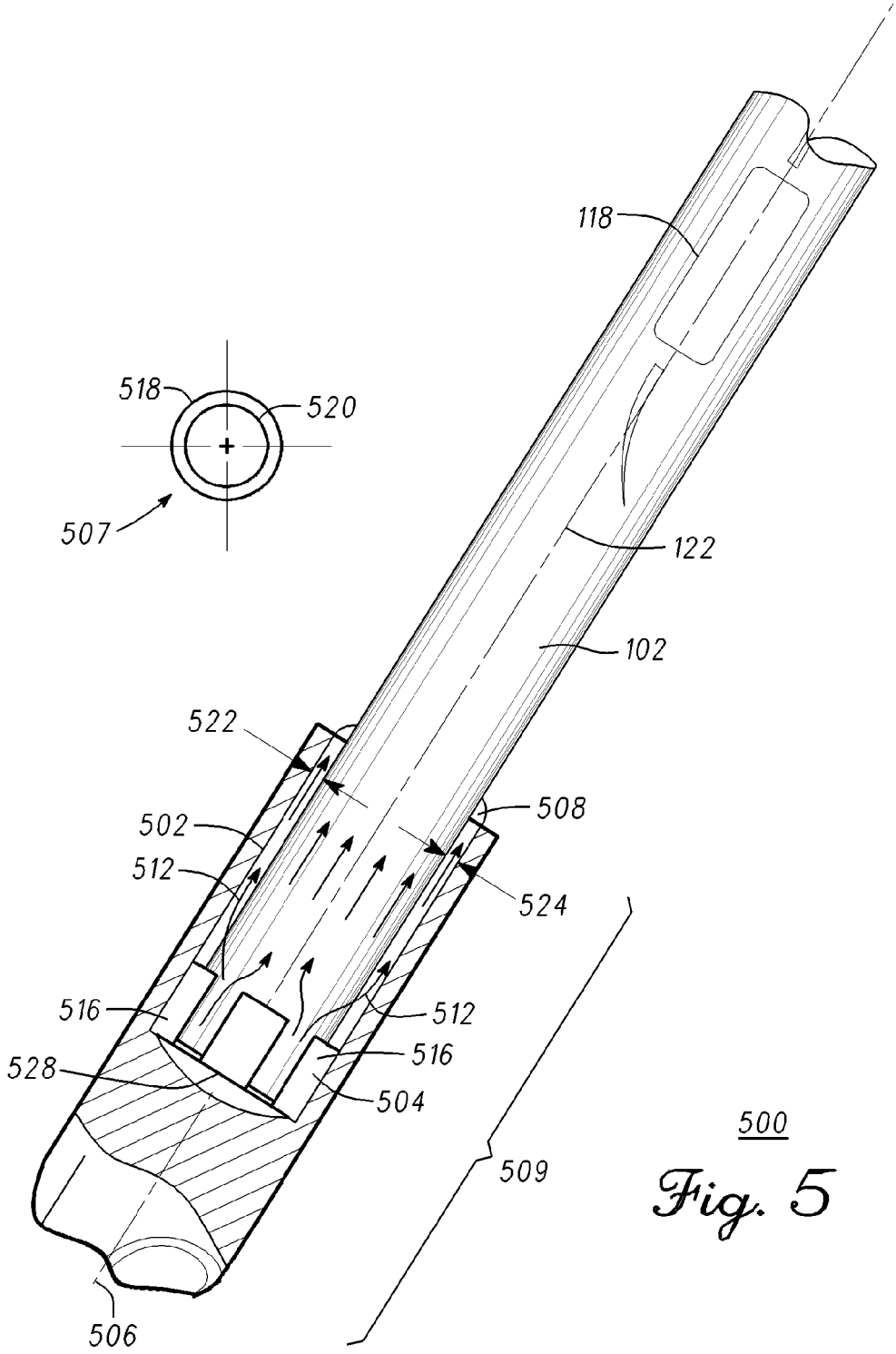
FIG. 5 shows a close up view of a parallel hosel bore with a shaft cap disposed in it showing epoxy flow during assembly.

FIG. 5 shows a close up view of a hosel bore 502 associated with a shaft cap 504 and an adhesive flow 512 during assembly. The adhesive or epoxy 508, may be epoxy or other equivalent bonding agents. The hosel bore 502, the shaft 102 and the shaft cap 504 may form an assembly 500. The shaft cap 504 is disposed at the end of the shaft 102 and assembled to a hosel bore 502 having an uncured adhesive disposed in it. The shaft 102 with the shaft cap 504 is inserted into the hosel bore 502 with the shaft cap 504 pushing the epoxy 508 from the bottom of the hosel bore 502 and up the sides of the hosel bore 502 in a manner as depicted by the arrows showing adhesive flow 512. The epoxy 508 can be kept out of the interior of the shaft 102 by the shaft cap 504, and the shaft 102 may be centered in the bore 502 by the shaft cap 504.

The shaft cap 504 may alternatively be called an end cap, a shaft end cap, an epoxy flow control device, a polypropylene plug, or a winged centering device. In this view, the hosel 509 is shown in section view, but the shaft 102, including the shaft cap 504 disposed on its end, are both rendered as un-sectioned.

A club assembled with a shaft cap 504 may allow a straight, parallel or un-tapered hosel bore 502 to be used that may improve alignment of the hosel bore 502 and the shaft 102. Thus, the centerline of the shaft 122 may align or be coincident with the centerline of the hosel bore 506. The shaft cap 504 may also control and direct the flow 512 of the epoxy 508 during manufacturing to direct the liquid epoxy to the bonding surfaces, and prevent it from flowing into areas (such as the interior of the shaft) where its presence could cause problems. In this hosel assembly, the shaft 102 may be glued, epoxied, or sealed by equivalent adhesive materials into the hosel bore 502 along with the shaft cap 504. If the epoxy 508 is used it can have an exemplary viscosity range of 7,000 to 22,000 centipoise ("cps"). However, other ranges of viscosity may be utilized depending upon variations possible in shaft cap configurations.

The use of a shaft cap 504 in assembly, typically allows for accurate alignment of the long axis of the shaft 122 with the long axis or centerline 506 of the hosel bore 502. This may be seen by looking down the coincident center lines in an end view 507. The circumference of the shaft 520 may be substantially concentric with the circle representing the circumference of the hosel bore 518 and the circles appear to have substantially the same center (also shown as 204 in FIG. 2). The shaft 102 with the graphic 118 may be aligned with the club head or face (e.g., 106 of FIG. 6), simply by turning the shaft 122 into the desired orientation.

By using a shaft cap 504 to assemble the shaft 122 to the hosel 509, a straight or zero taper hosel bore 502 may be disposed in the hosel 509, (in an alternative example, a tapered hosel bore 502 may also be used). The zero taper hosel bore 502, typically allows for less play between the shaft 102 and the hosel bore wall which may allow for a better shaft alignment due to the typically tighter fit 522, 524 between the shaft 102 and the hosel bore 502 plus the guiding action of the shaft cap 504.

The hosel bore 502 described in connection with the shaft cap 504 generally refer to a blind hole disposed into a solid piece or area such as the hosel 509. The hosel bore 502 need not be a through hole (although it could be), so that there may be only one opening. The hole is typically not a through hole that might open into an opposite side or into a cavity such as a hollow club head. Also, there may be secondary openings through the walls of the hosel bore 502, such as might accommodate the insertion of a pin, screw or the like to secure an ancillary piece, or the shaft. The bore 502 may be cast, drilled, bored or created by other equivalent methods.

The shaft cap 504 may be disposed on the end of a shaft 102 that may be disposed into the hosel bore 502. The hosel bore 502 may already have a given quantity of epoxy 508 disposed into it. The shaft cap 504 may serve as a plunger, or piston during assembly. As the shaft 102 with the shaft cap 504 on its end is pushed into the hosel bore 502, air trapped in the hosel bore 502 may escape from one or more holes 528 disposed in the base of the shaft cap 504, or from around the base of the shaft cap 504. As the shaft cap 504 contacts the fluid epoxy, the epoxy 508 in the bottom of the hosel bore 502 is pushed or caused to flow from the bottom of the hosel bore 502 around the shaft cap 504 sides (or wings) 516 and into the gap 522, 524 between the outer wall of the shaft 102 and the wall of the hosel bore 502 in a manner as shown by the adhesive flow 512. Excess epoxy 508 may flow out the top of the hosel bore 502 as the shaft 102 with the shaft cap 504 reaches the bottom of the hosel bore 502. The hosel bore 502 may be sufficient diameter so that the shaft cap 504 comes to rest at the bottom of the hosel bore 502. Also, the shaft cap 504 tends to position the shaft 102 in the hosel bore 502. Excess epoxy may be wiped away or removed by any suitable methods.

As the shaft cap 504 pushes into the hosel bore 502, air may be trapped causing resistance to inserting the shaft 102 with the shaft cap 504 into the hosel bore 502. A hole 528 in the shaft cap 504 may allow for air to flow into the shaft 102 as the shaft 102, may be hollow. In addition, once the air is expelled, some amount of epoxy 508 may flow into the hole 528 after the air is dispelled. Such epoxy may form a plug after it cures. Excess epoxy disposed into the shaft 122 in this manner may stay attached to the shaft cap 504 instead of breaking off and causing rattling in the club.

As can be seen, the gaps 522 and 524 may remain substantially even because of the guiding action of the shaft cap 504. The shaft cap 504 tends to keep the shaft centered within the hosel bore 502 so that play in the shaft tends not to be present at the end of the hosel bore 502 where the shaft 102 exits the hosel bore 502. This alignment caused by the shaft cap 504, tends to preserve the alignment of the center line of the shaft 122 with the center line of the hosel bore 506 so that club performance may be improved through better tolerancing in the assembly of the club.

In addition, since the epoxy does not flow in substantial amounts into the shaft 102 itself, precise metering of the epoxy to minimize waste may be achieved. Precise amounts of epoxy needed to flow out from the gap between the hosel bore 502 and the shaft 102 once the shaft 102, with the shaft cap 504, is inserted may be calculated and dispensed. The shaft 102 with the shaft cap 504 acts as a solid plunger to cause the epoxy 508 to rise to the top of the hosel bore 502 without a substantial amount, if any, flowing out of the top. This may allow for minimizing waste epoxy during assembly and also to act to simplify the assembly as wiping may be minimized. Also, epoxy may be dispensed directly into the hosel bore 502 instead of being separately applied may by one or more technicians in multiple stages.

Figure 6:
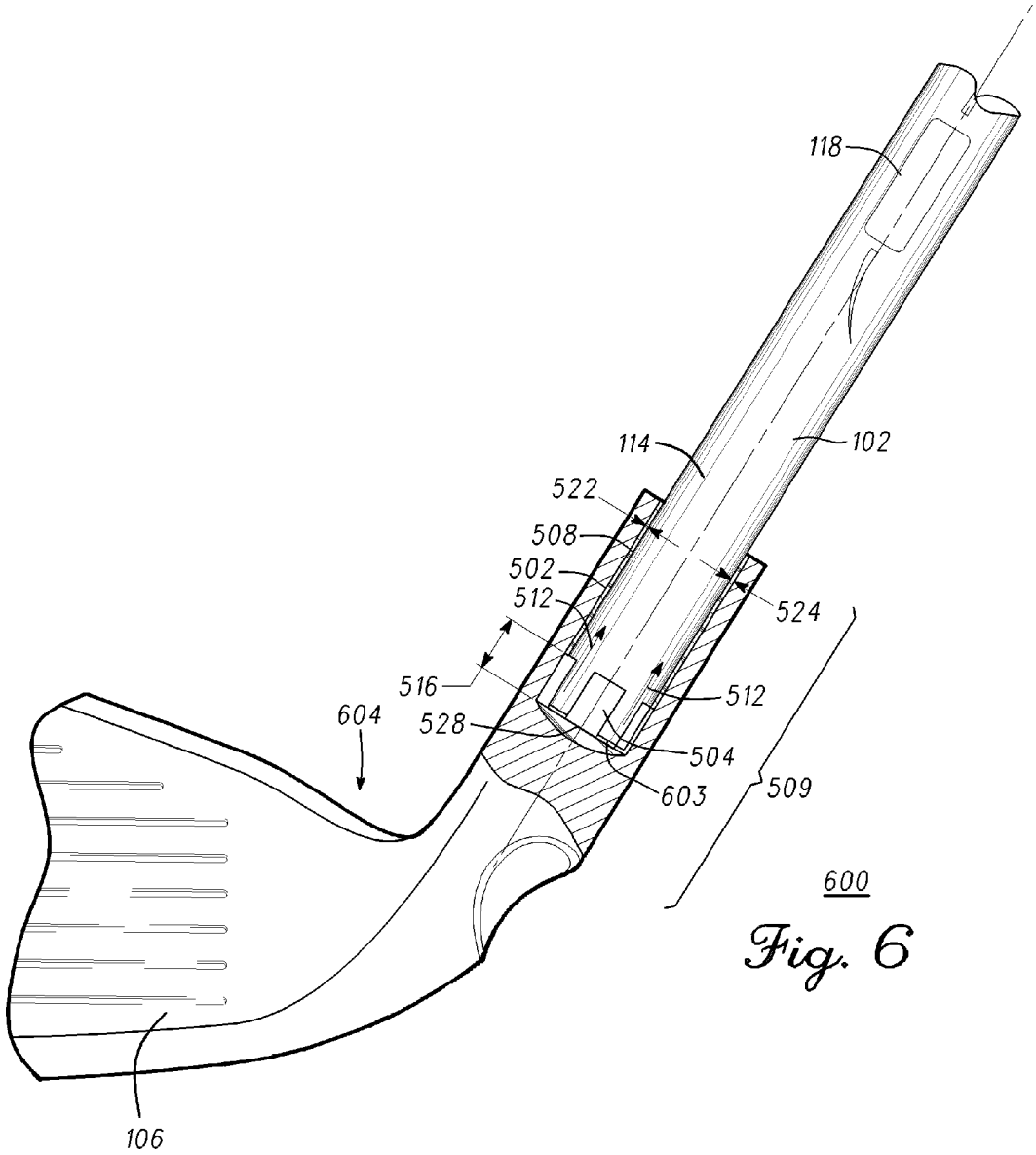
FIG. 6 shows a detailed view of a first example of a hosel of the golf club assembled with a shaft cap, in which the hosel bore is parallel.

FIG. 6 shows a club head 604, including a first example of a hosel 509 of the golf club 600 assembled with a shaft cap 504, and having a parallel hosel bore 502. In this view the hosel bore 502 is straight. The example shown is substantially constructed as previously described in FIG. 5. However, more of the club head 604 is shown in this view. The bore 502 may be of sufficient diameter to allow the shaft cap 504 to come to rest at the bottom of the hosel bore 502.

A shaft cap 504 may be disposed at a hosel end of a shaft 114 to form a shaft assembly. The shaft cap 504 may stay on the shaft 102 as it may be a close fit, and may also be somewhat flexible so that it may conform to the shaft 102 and hold its self in place during assembly.

A club head 604 may have epoxy 508 disposed in a hosel bore 502. The epoxy 508 may be metered to minimize waste. The club head 604 may be a wood, iron, sand wedge, putter or the like, and typically includes a club face 106 and the hosel 509.

In assembly, the shaft 102 with the shaft cap 504 disposed on its end, may be inserted into the hosel bore 502 having the epoxy 508 disposed in its bottom. As the shaft 102 and cap 504 are inserted into the hosel bore 502 air in the bore escapes through a hole 528 in the shaft cap 504 and around the base 603 and sides 516 of the shaft cap 504. As the epoxy 508 is contacted by the shaft cap 504, the shaft cap 504 may push the epoxy 508 over the base of the shaft cap between the openings in the sides of the shaft cap and into the space between the wall of the bore and the outer wall of the shaft As shown by arrows representing epoxy flow 512. The shaft 102 tends to center in the bore 502 making an even epoxy bond around the circumference of the shaft 522, 524. The hole (or opening) 528 allows air trapped at the bottom of the bore 502 to escape so that an air bubble tends not to be trapped at the base of the bore. The opening 528 is designed to allow a small amount of epoxy to pass (if any), that tends to form into a shape that remains securely coupled to the structure formed.

Figure 7:
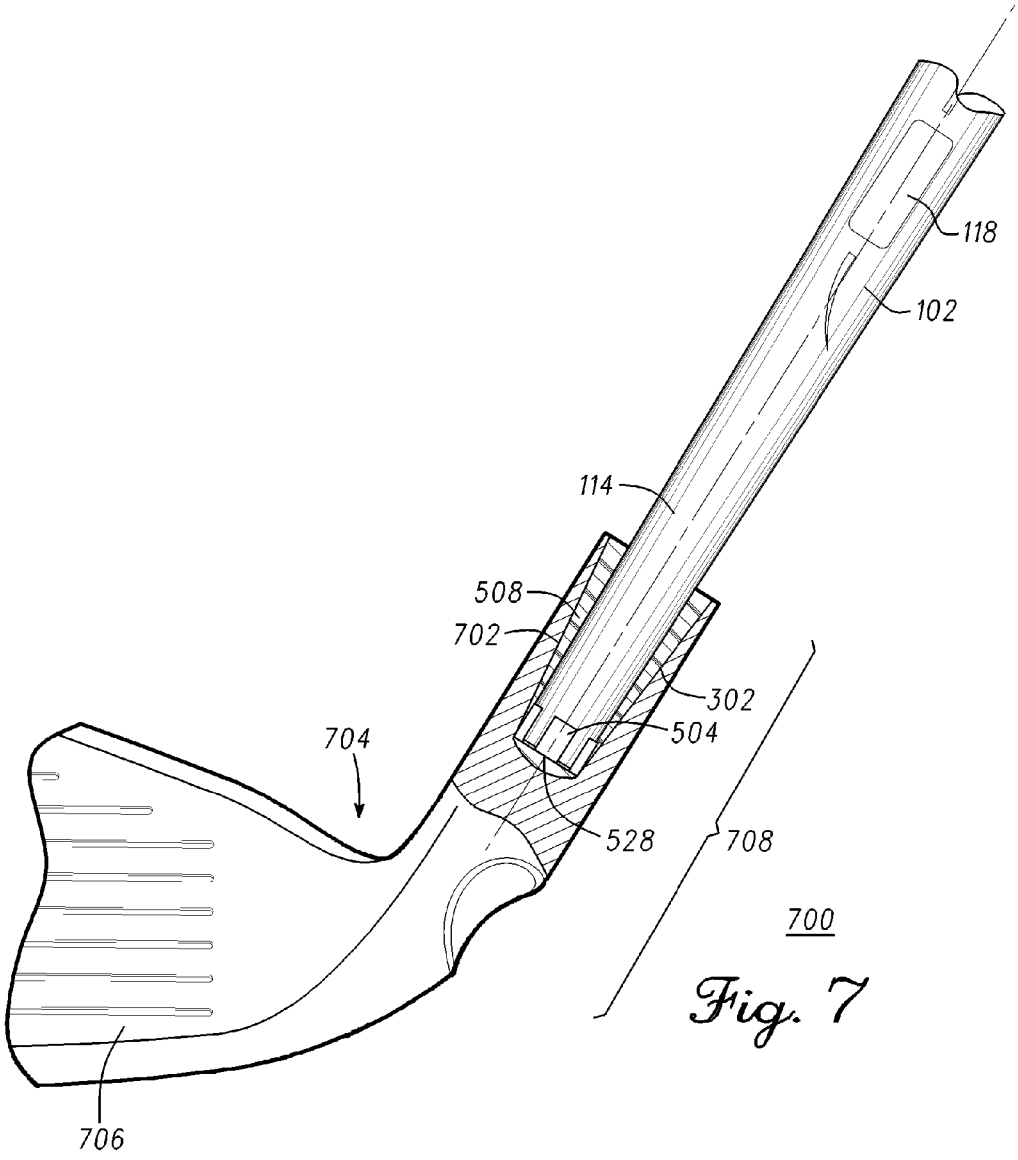
FIG. 7 shows a detailed view of a second example of a hosel of the golf club assembled with a shaft cap, in which the hosel bore is tapered.

FIG. 7 shows a club head 704 including a second example of a hosel 708 of the golf club 700 assembled with a shaft cap 504, in which the hosel bore 702 is tapered. The example shown, is substantially constructed as previously described in FIG. 6. However, in this example the hosel bore 702 may be tapered and the dimensions and fit of the shaft cap 504 may be adjusted accordingly to provide a proper fit and alignment of the head 704 to the shaft 102. The hosel bore 702 may be of sufficient diameter to allow the shaft cap 504 to come to rest at the bottom of the bore hole 702. However, in alternative examples the shaft cap 504 may rest against the walls of the bore 702 before seating at the bottom when the bottom of the tapered bore hole is of lesser diameter than the diameter of the shaft cap base.

A shaft cap 504 may be disposed at a hosel end of a shaft 114 to form a shaft assembly. The shaft cap 504 tends to stay on the shaft 102 as it may be a close fit, and may also be somewhat flexible so that it may conform to the shaft 102 and hold itself in place during assembly.

A club head 704 may have epoxy 504 disposed in a hosel bore 702 that may be straight, or in alternative examples tapered. The epoxy 504 may be metered to minimize waste. The club head 704 may be a wood, iron, sand wedge, putter or the like.

In assembly the shaft 102 with the shaft cap 504 disposed on its end may be inserted into the hosel bore 702 having the epoxy 508 disposed in its bottom. As the shaft 102 and cap 504 are inserted into the hosel bore 702 air in the bore 702 escapes through a hole 528 in the shaft cap 504 and around the base and sides of the shaft cap 504. As the epoxy 508 is contacted by the shaft cap 504, the shaft cap 504 may push the epoxy 508 over the base of the shaft cap 508 between the openings in the sides of the shaft cap 508 and into the space between the wall of the bore 702 and the outer wall of the shaft 102. The shaft 102 tends to center in the bore making an even epoxy bond around the circumference of the shaft 102. The hole 528 allows air trapped at the bottom of the bore 508 to escape so that an air bubble tends not to be trapped at the base of the bore 508. The opening is designed to allow a small amount of epoxy to pass (if any), that tends to form into a shape that remains securely coupled to the structure formed. Shaft caps 504 may have a variety of alternative forms (such as 800 of FIG. 8, 900 of FIG. 9, 1000 of FIG. 10, 1200 of FIG. 12, 1300 of FIG. 13 and other equivalent forms) as described below.

Figure 8:
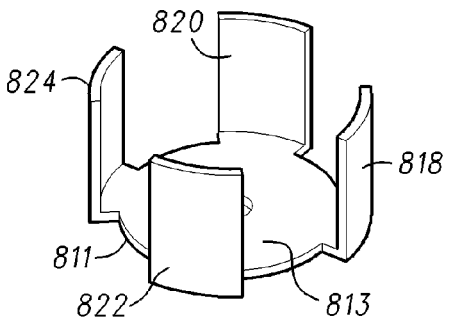
FIG. 8 shows a first example of a shaft cap.
Figure 8:
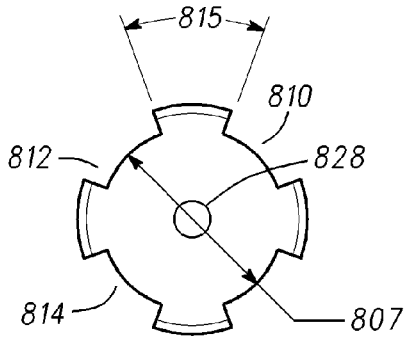
Figure 8:
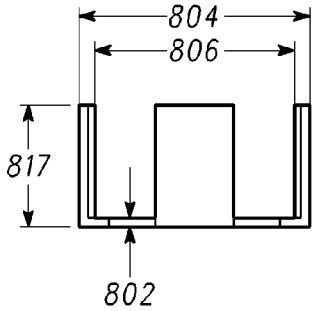

FIG. 8 shows a first example of a shaft cap 800 having quadruple wings or flutes. The shaft cap 800 may have a plurality of flutes, wings, side surfaces or walls (e.g., generally shown as 818, 820, 822, 824) that may be coupled together by a bottom surface, or base 813, typically at an edge, or circumference of the base 811. Although FIG. 8 may depict a shaft cap having a particular number of wings, the methods, apparatus, and articles of manufacture described herein may include a shaft cap with more or less wings. The wings 818, 820, 822, and 824 may be of uniform thickness or may vary in their thickness over their height 817 in order to provide a better fit. Spaces 808, 810, 812, 814 may be disposed between the wings, typically to aid the flow of epoxy and to provide for bonding between a shaft (not shown) and a hosel bore wall (not shown). The shaft caps described below may be made of any suitable material such as polypropylene, polycarbonate, urethane or the like. The shaft cap may also be made of metal such as brass or the like.

The base 813 may prevent the side walls from sliding up the shaft (such as 102 of FIG. 6) further (as a simple ring might) than desired and otherwise acts to join the wings 818, 820, 822, 824 into a unitized cap, or shaft cap 800. The base of the shaft cap 813 may be of a diameter sufficient to cover the inside diameter of the shaft (such as 102 of FIG. 6) or up to the outer diameter of the shaft (such as 102 of FIG. 6) as needed. The diameter 806 of the arc formed by the wings 818, 820, 822, 824 allows the shaft cap 800 to fit over a shaft (such as 102 of FIG. 6), and the diameter 807 of the base 813 can be made smaller than diameter 806 to accommodate epoxy flow during assembly. However, as the base diameter is increased epoxy flow may be decreased. Therefore, if the base diameter is made to approach the shafts outer diameter additional nicks or gaps (not shown) may be let out in the base 813 to allow epoxy to flow past the edge of the base 811 and between the wings or side walls 818, 820, 822, 824.

The base 813 of the shaft cap 800 may include an opening or aperture 828. The opening 828, is typically chosen so that when the shaft cap 800 on the end of the shaft (such as 102 of FIG. 6) is inserted into the bore (such as 502 of FIG. 6), that air or a small amount of epoxy may flow through the hole 828 and the majority of the epoxy may be forced past the base 813 and up the sides of the hosel bore (such as 502 of FIG. 6) between the shaft cap wings 818, 820, 822, 824 through the gaps 807, 810, 812, 814. Gaps 808, 810, 812, 814 may allow epoxy to flow on the bottom of the hosel bore (such as 502 of FIG. 6) up the sides of the shaft (such as 102 of FIG. 6) to the top of the bore (such as 502 of FIG. 6).

The side walls or wings 818, 820, 822, 824 may rest against or otherwise contact the exterior of the shaft (such as 102 of FIG. 6) on a first wing side. And on a second wing side, the shaft wall or surface may rest against or come in contact with the wall of the hosel bore (such as 502 of FIG. 6) during an assembly process. Typically, the shaft cap wings 818, 820, 822, 824 fit snuggly against the exterior of the shaft (such as 102 of FIG. 6) so that the shaft cap 800 may be disposed on the end of the shaft (such as 102 of FIG. 6) and then inserted into the hosel bore (such as 502 of FIG. 6) without falling off.

The side wall length 816 of the shaft cap 800 may be chosen to promote alignment of the shaft (such as 102 of FIG. 6) and the hosel bore (such as 502 of FIG. 6). In one example, the side wall length 816 may be a percentage of the hosel bore (such as 502 of FIG. 6), or other suitable length determined to allow sufficient centering of the shaft (such as 102 of FIG. 6) in the hosel bore (such as 502 of FIG. 6). In the example shown, four wings, 818, 820, 822, 824 are shown, however, in alternative examples described below, varying numbers of wing and wing configurations may be utilized that may provide sufficient centering.

Dimensions for a shaft cap 800 made from polypropylene or similar material are now given for an example of a shaft cap 800. The thickness 802 of the base 813 may be substantially 0.012 inches, with the hole 828 disposed in the base 813 measuring substantially 0.06 inches in diameter. The wings 818, 820, 822, and 824 each extend over an arc of substantially 40 degrees 815, and have a height 817 of substantially 0.20 inches. The inner diameter of a circle defined by the arcs of the wings 806 is substantially 0.35 inches. The outer diameter of a circle defined by the arcs of the wings 804 is substantially 0.38 inches. Other dimensions are possible depending upon the hosel bore (such as 502 of FIG. 6) and the shaft (such as 102 of FIG. 6) fitted into the hosel bore (such as 502 of FIG. 6). The dimensions above are solely being given as an example.

Figure 9:
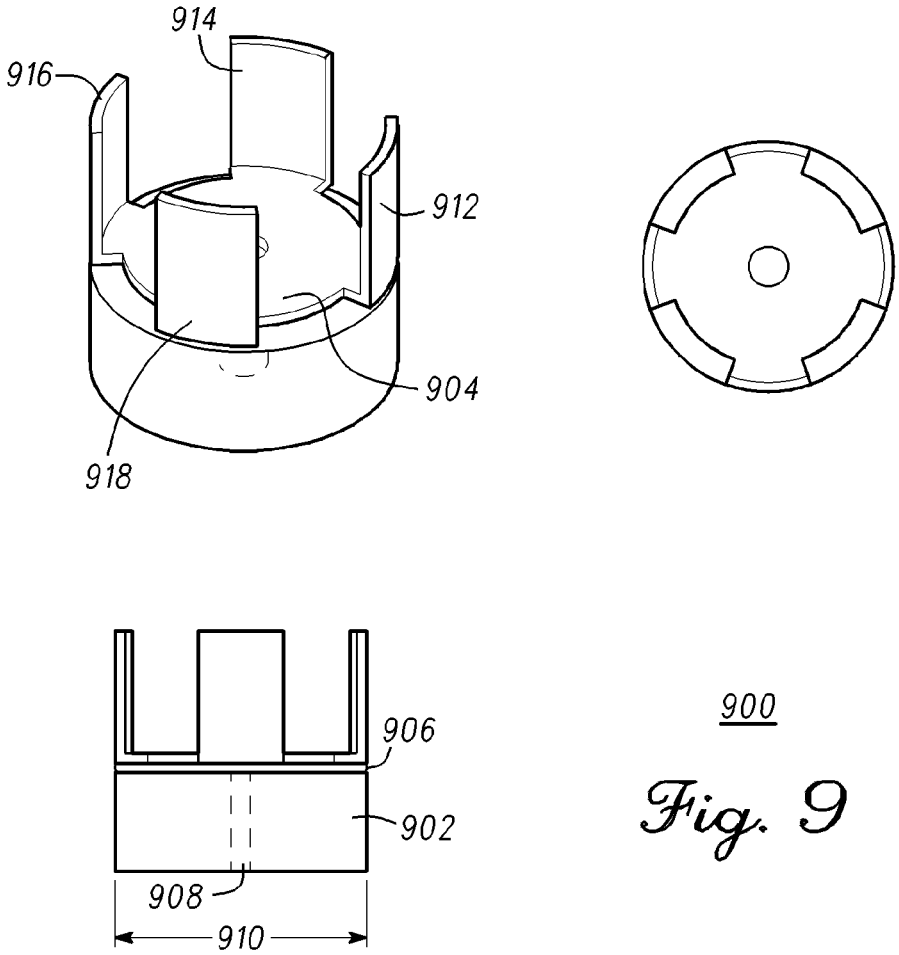
FIG. 9 shows a second example of a shaft cap.

FIG. 9 shows a second example of a shaft cap 900 having a weight 902 incorporated into it. Woods and the like may incorporate a weight 902 added to customize a club. The weight 902 may be disposed at the end or base 904 of the shaft cap 900 which is in turn disposed in the hosel bore (such as 502 of FIG. 6). Weights 902 may be made from a variety of material such as, aluminum, brass, iron, or the like. Here, an appropriate weight 902 may be disposed at the base of a shaft cap 904, such as the exemplary shaft cap (800 of FIG. 8) or other similarly configured shaft cap. The shaft cap 904 may be bonded 906 or otherwise coupled to the weight 902. The weight 902 also includes one or more holes or apertures 908 matching the hole disposed in the shaft cap base 904. Weight diameter 910 should be small enough to allow the flow of epoxy from beneath the weight 902, around the wings 912, 914, 916, 918 and up the shaft (such as 102 of FIG. 6).

Shaft cap 900 may come preassembled with various weights attached to them. During the assembly process, the appropriate shaft cap 900 with a weight 902 may be disposed at the end of the shaft (such as 102 of FIG. 6) and inserted into the hosel bore (such as 502 of FIG. 6) to produce the appropriate weight.

Figure 10:
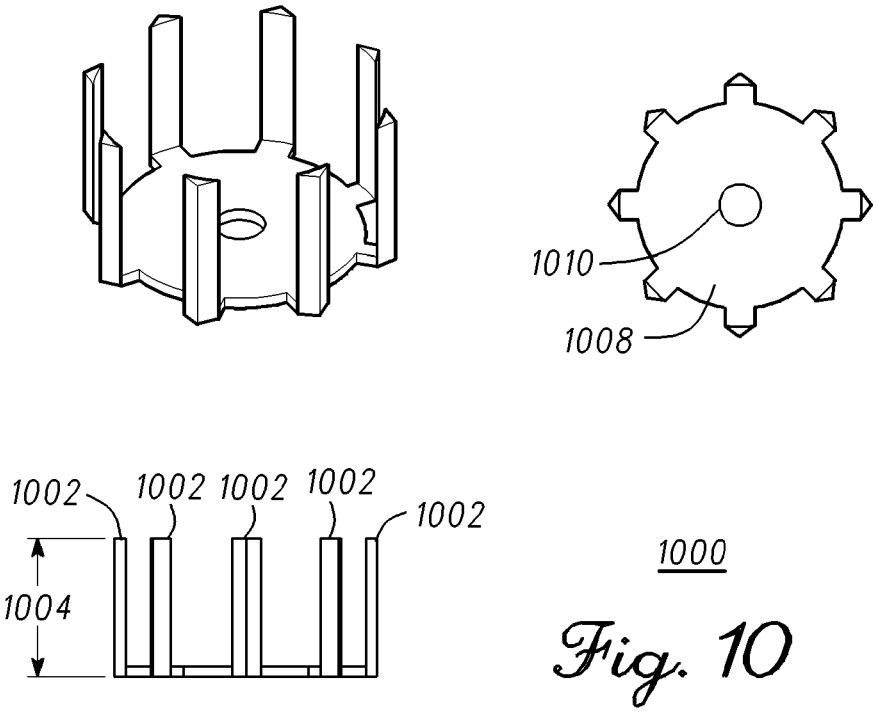
FIG. 10 shows a third example of a shaft cap.

FIG. 10 shows a third example of a shaft cap including splines 1000. The shaft cap 1000, may include a plurality of splines or splines 1002 disposed as spacers between the wall of the hosel bore (such as 502 of FIG. 6) and the shaft (such as 102 of FIG. 6). The splines 1002 may be coupled to a base 1008, typically including one or more relief holes or apertures 1010. Any number of splines 1002 to provide sufficient alignment may be provided. Spline length 1004 may be selected so that sufficient alignment may be provided. At the base 1008 of the shaft cap 1000, one or more holes 1010 may be disposed to allow for epoxy flow. The shaft cap 1000 may allow for seating of the shaft cap 1000 to the base of the hosel bore (such as 502 of FIG. 6) allowing for somewhat of a more secure attachment or initial fit.

Figure 11:
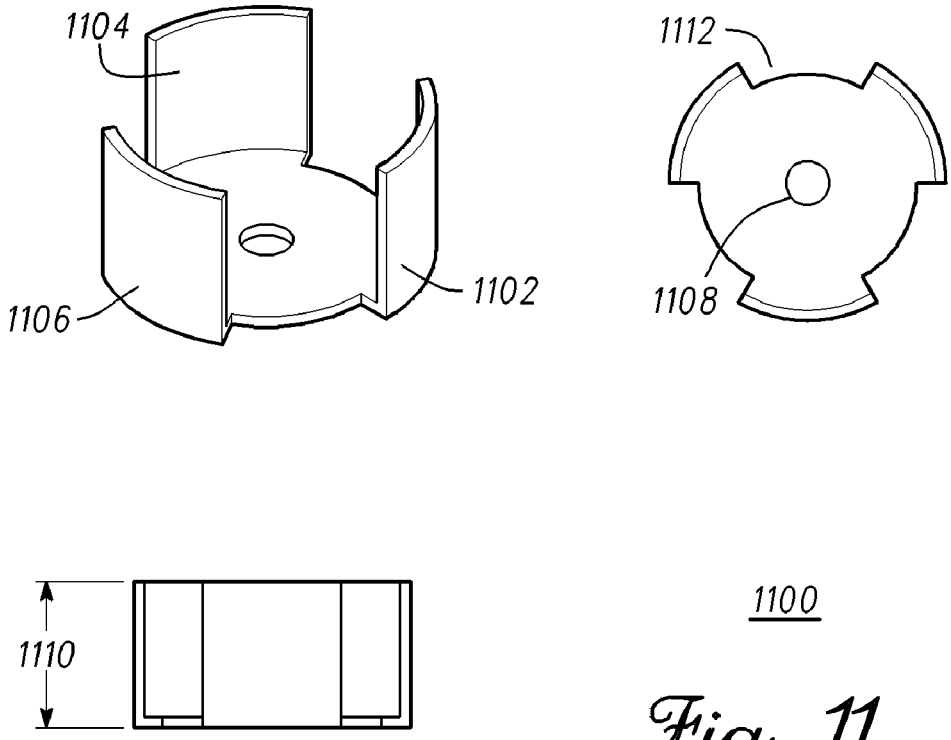
FIG. 11 shows a fourth example of a shaft cap.

FIG. 11 shows a fourth example of a shaft cap 1100 having triple wings or sides. In shaft caps 1100 having fewer wings which can be wider care should be taken to maintain wall integrity, as is typical in molded parts, as wings that are too wide may collapse. Thus a metal shaft cap may be more suitable for these designs. The shaft cap 1100 may include three sides 1102, 1104, 1106 coupled to a base 1112. Any number of sides may be provided as long as sufficient fit to the shaft (such as 102 of FIG. 6), and sufficient epoxy flow between the sides or wings 1102, 1104, 1106 is provided for. A single center hole 1108 is shown. However, alternative arrangements allowing a plurality of holes or apertures having circular or other shapes may be provided. Likewise, the length of the sides 1110 may be chosen to allow sufficient alignment of the shaft (such as 102 of FIG. 6) and the bore (such as 502 of FIG. 6). Likewise, the base 1112 may be sized to allow the flow of epoxy from the base of the hosel bore (such as 502 of FIG. 6), past the base 1112 and around the sides 1102, 1104, 1106 to fill the gap between the hosel bore (such as 502 of FIG. 6) and the shaft (such as 102 of FIG. 6).

Figure 12:
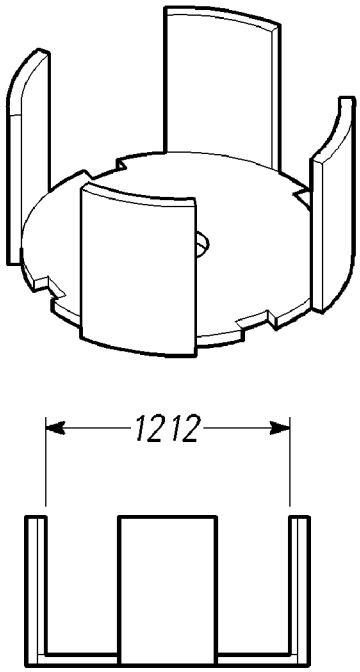
FIG. 12 shows a fifth example of a shaft cap.
Figure 12:
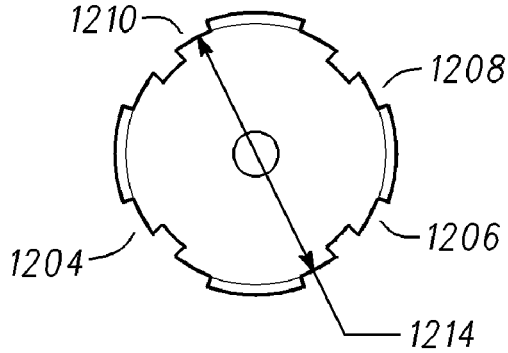

FIG. 12 shows a fifth example of a shaft cap 1200 with limited or reduced base undercutting. The shaft cap 1200 may include a base diameter 1214 substantially the same as an outer-diameter 1212 of the club shaft (such as 102 of FIG. 6). The shaft cap 1200 may include nicks or groves 1204, 1206, 1208, 1210, to allow the flow of epoxy from the bottom of the hosel bore (such as 502 of FIG. 6), around the sides and up the bore, filling the void between the shaft (such as 102 of FIG. 6) and hosel bore (such as 502 of FIG. 6) wall with epoxy.

Figure 13:
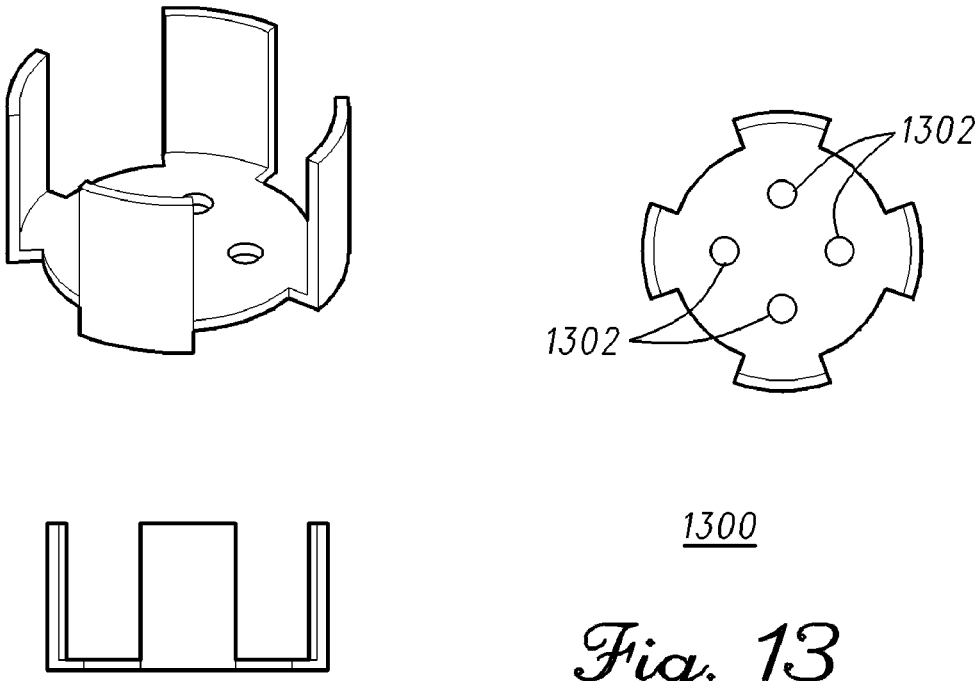
FIG. 13 shows a sixth example of a shaft cap.

FIG. 13 shows a sixth example of a shaft cap 1300 having multiple pressure relief holes or apertures 1302. As shown, the shaft cap 1300 may include a plurality of exemplary holes or apertures 1302. The shaft cap 1300 may be a variation of the shaft cap shown in the FIG. 8, or other exemplary shaft caps described above or otherwise possible to construct.

Figure 14:
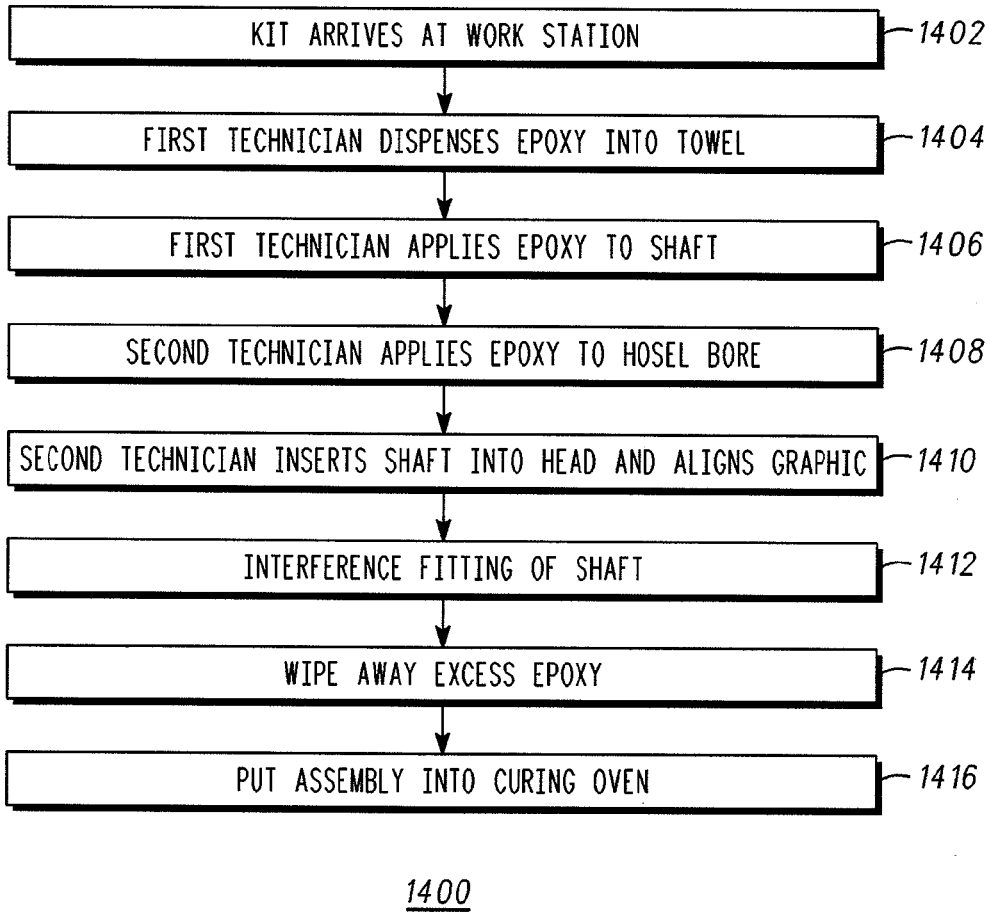
FIG. 14 shows a process for coupling a head to a shaft of a golf club.

FIG. 14 shows a process 1400 for coupling a head to a shaft of a golf club. This head-to-shaft coupling process may be a two or more person operation. First, a kit arrives at the work station 1402. The kit may include the club head, the precut shaft and other materials that may be needed for club assembly. Prior to assembly, for example, a first technician may dispense epoxy onto a towel, cup or other suitable storage container or surface for application 1404. Next, the first technician may spread the epoxy from the towel 1406 on the shaft with an applicator tool. Next, a second technician may spread epoxy on the walls of the hosel bore 1408 with another tool or applicator. The second technician may insert the shaft to the head 1410 and align any shaft graphic present with the head. The second technician may then seat the shaft into the head using, for example, a pneumatic hammer or the like 1412. Maintaining alignment of the graphic may be difficult as the vibrations of the pneumatic hammer or the motion of inserting the shaft into the pneumatic hammer may cause misalignment. After seating, a third technician may then take the club and wipe any excess epoxy from the top of the hosel bore and shaft interface 1414. The shaft and club head assembly is typically sent to a curing oven 1416, where the epoxy may be heated until it sets sufficiently for further handling, such as assembling a grip.

Figure 15:
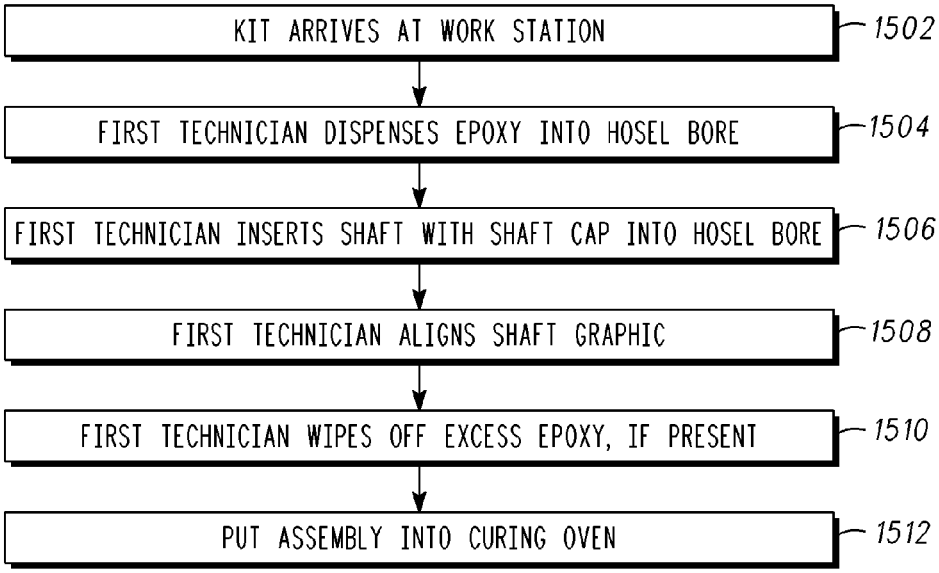
FIG. 15 shows a process for assembling a golf club having a shaft cap.

FIG. 15 shows a process 1500 for assembling a golf club having a shaft cap. This process may be a one-person operation. First, the kit arrives at the work station containing materials for assembling the head to the shaft 1502. This kit may include a precut shaft having a coated area removed from it and a shaft cap coupled to it, and the golf club head. Alternatively, the shaft caps may be provided at the assembler's work station.

Then, a technician dispenses epoxy into the head 1504. An epoxy dispensing system that delivers a pre-measured amount of epoxy may be provided at the work station with flow set to the amount needed for the hosel bore and shaft assembly.

Next, the technician inserts a shaft having a shaft cap disposed on its end and to the hosel bore having the epoxy 1506. The shaft cap may have been preassembled to shaft, or the shaft cap may have been assembled to the shaft by the technician immediately preceding inserting the shaft cap and shaft into the hosel bore containing the epoxy. The technician pushes the shaft into the bore until it is seated, or bottoms out and then turns the shaft until the art work on the shaft aligns with the club head 1508. A technician may then wipe off any access epoxy from the shaft 1510. Wiping may be optional as the amount of epoxy may be precisely metered into a hole so that little or no excess may be present. Next, the head and shaft assembly is taken to the curing area 1512.

Although a particular order of actions is illustrated in FIGS. 14 and 15, these actions may be performed in other temporal sequences. For example, two or more actions depicted in FIG. 15 may be performed sequentially, concurrently, or simultaneously.

Those skilled in the art will realize that the process sequences described above may be equivalently performed in any order to achieve a desired result. Also, sub-processes may typically be omitted as desired without taking away from the overall functionality of the processes described above.

The invention claimed is:

1. A shaft cap for a golf club shaft comprising:

a plurality of wings, and a base coupled to the plurality of wings, each wing of the plurality of wings being entirely spaced from a next adjacent wing of the plurality of wings on the base by a respective interstitial space, wherein the plurality of wings extends in a perpendicular relation relative to the base, and wherein the plurality of wings and the base collectively define an interior space having a diameter, wherein the interior space communicates with each respective interstitial space.

2. The shaft cap of claim 1, wherein the plurality of wings is shaped to match the curvature of a golf club shaft.

3. The shaft cap of claim 1, wherein the base has a diameter less than an outer diameter of a golf club shaft.

4. The shaft cap of claim 3, wherein the base defines a single aperture.

5. The shaft cap of claim 3, wherein the base defines at least one aperture.

6. The shaft cap of claim 3, further comprising:

one or more nicks defined between each respective pair of the plurality of wings.

7. The shaft cap of claim 1, wherein the shaft cap is made from polyproplylene.

8. The shaft cap of claim 1, wherein the shaft cap is made from a metal or metal composite.

9. The shaft cap of claim 1, wherein the plurality of wings is four wings.

10. The shaft cap of claim 1, further comprising:

A weight disposed on the base of the shaft cap.

11. The shaft cap of claim 1, wherein the plurality of wings is formed as splines.

12. The shaft cap of claim 11, wherein each of the splines has a triangular configuration.

* * * * *